US007895751B2

(12) United States Patent
Coha et al.

(10) Patent No.: US 7,895,751 B2
(45) Date of Patent: Mar. 1, 2011

(54) VARIABLE SHIM FOR SETTING STROKE ON FUEL INJECTORS

(75) Inventors: Timothy F. Coha, Canandaigua, NY (US); Charles J. Badura, Penfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 421 days.

(21) Appl. No.: 12/008,947

(22) Filed: Jan. 15, 2008

(65) Prior Publication Data

US 2009/0179089 A1 Jul. 16, 2009

(51) Int. Cl.
*B21K 1/20* (2006.01)

(52) U.S. Cl. ..... 29/890.124; 29/890.12; 29/890.131; 239/585.1; 251/129.15; 251/359

(58) Field of Classification Search ..... 29/890.12, 29/890.124, 890.131; 239/585.1–585.4, 239/538; 251/129.15, 359–365
See application file for complete search history.

(56) References Cited

U.S. PATENT DOCUMENTS 4,798,329 A * 1/1989 Mesenich ..... 239/5
4,951,874 A * 8/1990 Ohnishi et al. ..... 239/88
5,417,403 A * 5/1995 Shurman et al. ..... 251/129.16
5,638,783 A * 6/1997 Regueiro ..... 123/90.22
6,032,630 A * 3/2000 Yamamoto et al. ..... 123/90.54
7,175,158 B2 * 2/2007 Thomas ..... 251/359
2004/0262562 A1 * 12/2004 Maula et al. ..... 251/331

FOREIGN PATENT DOCUMENTS

DE 3540660 5/1987
DE 19533290 3/1996
DE 19958705 6/2001

OTHER PUBLICATIONS

EP Search Report dated Oct. 14, 2009.

* cited by examiner

*Primary Examiner*—David P Bryant
*Assistant Examiner*—Ryan J Walters
(74) *Attorney, Agent, or Firm*—Thomas N. Twomey

(57) ABSTRACT

A variable shim and valve seat assembly for applications in a solenoid actuated fuel injector includes a variable shim having a face, a valve seat having a top surface that interfaces with the face, and mating features integrated in the face of the variable shim and the top surface of the valve seat. The mating features provide axial displacement of the valve seat through rotation of the valve seat relative to the variable shim. The mating features may be ramped surfaces. The amount of seat displacement is dependent on the designed ramp angle, the number of ramps, and the degree of rotation. Once the desired valve stroke is set, the seat is welded to the injector body to achieve a leak free interface. Tight stroke setting tolerances can be achieved by applying an axial load to the seat during stroke setting and welding.

3 Claims, 4 Drawing Sheets

VARIABLE SHIM FOR SETTING STROKE ON FUEL INJECTORS

TECHNICAL FIELD

The present invention relates to fuel injection systems of internal combustion engines; more particularly, to solenoid actuated fuel injectors; and most particularly, to a variable shim and valve seat assembly and to a simplified method for setting the injector valve stroke.

BACKGROUND OF THE INVENTION

Fuel injected internal combustion engines are well known. Fuel injection is a way of metering fuel into an internal combustion engine. Fuel delivery is typically through engine intake ports but is more recently directly into the cylinder through the engine head. Accordingly, fuel injection arrangements may be divided generally into multi-port fuel injection (MPFI), wherein fuel is injected into a runner of an air intake manifold ahead of a cylinder intake valve, and direct injection (DI), wherein fuel is injected directly into the combustion chamber of an engine cylinder, typically during or at the end of the compression stroke of the piston. DI is designed to allow greater control and precision of the fuel charge to the combustion chamber, providing the potential for better fuel economy and lower emissions. DI is also designed to allow higher compression ratios, providing the potential for delivering higher performance with lower fuel consumption compared to other fuel injection systems. As the industry moves more towards the fuel delivery directly into the cylinder, it is highly desirable in a modern internal combustion engine to provide high pressure fuel injectors that more precisely deliver fuel.

Generally, fuel injectors rely on internal valves to open a precise distance to deliver exact amounts of fuel to the engine. An electromagnetic fuel injector incorporates a solenoid armature, located between the pole piece of the solenoid and a fixed valve seat. The armature typically operates as a movable valve assembly. Electromagnetic fuel injectors are linear devices that meter fuel per electric pulse at a rate proportional to the width of the electric pulse. When an injector is energized, its movable valve assembly is lifted from one stop position against the force of a spring towards the opposite stop position. The distance between the stop positions constitutes the stroke.

A solenoid actuated fuel injector for automotive engines is required to operate with a small and precise stroke of its valve in order to provide a fuel flow rate within an established tolerance. The stroke of the moving mass of the fuel injector is critical to function, performance, and durability of the injector. Injectors for gasoline DI require a relatively high fuel pressure to operate. The fuel pressure may be, for example, as high as 1700 psi compared to about 60 psi required to operate a typical port fuel injection injector. Due to the higher operating pressure, the fuel flow of gasoline DI injectors is more sensitive to variations in stroke than port fuel injection injectors and, therefore, a tighter control of the stroke set is needed. Typically, a stroke tolerance of about +/−5 microns is desired for GDI injectors where a tolerance of about +/−14 microns is acceptable for port fuel injection injectors.

Methods for controlling the exactness of the valve opening are an ongoing design and manufacturing challenge. Current fuel injectors use a variety of methods to set and control the displacement of the valve. For example, adjusting the pole piece location is currently the most commonly used method for setting the stroke on fuel injectors. This method involves precisely pressing the pole piece to a position that gives the required valve displacement. Shortcomings of this method are the complexity of the part design, especially the achievement of the needed tolerances, and the process of accurately pressing the pole piece to the right depth without pressing too far. This approach also requires an external structure for the pole piece to slide inside thus adding more parts and cost. The sliding motion between the external structure and internal pole piece can also generate undesirable contamination in the injector. Stroke setting tolerance with this process can generally be in a +/−12 micron range.

Another current approach includes a threaded valve seat outer diameter and a threaded body inner diameter. By threading the outer diameter of the seat and the inner diameter of the body that the seat mates with, valve stroke is adjusted by controlling the depth that the seat is screwed into the body. This design is typically used on port injectors and functionally works satisfactory. The major shortcomings of this approach are the difficulty and cost of creating the very fine threads on the outer diameter of the small and hard seat as well as cutting threads on the inner diameter of the body. Once the correct stroke is set using this approach, the seat is typically spot welded to the body. An o-ring is usually fitted between the seat and the body to assure that no leakage occurs. Stroke setting tolerances with this process can generally be in a +/−12 micron range.

Still another approach is the selective flat shim method. The selection of a flat shim of a precise thickness to give the desired valve displacement is a long used method in high-pressure fuel injectors. The process typically involves taking interfacing component measurements, calculating the appropriate shim thickness, selecting the shim, and installing the shim into the injector during assembly. Shortcomings are that a large number of high precision shims of various thicknesses need to be on hand and ready for assembly. The mating part measurements are complex and difficult to integrate into a high volume manufacturing operation. Stroke setting tolerances with this process can generally be in a +/−5 micron range or better if disassembly and reassembly with a different shim is allowable. The shim selection method for setting the fuel injector stroke is, therefore, a very high cost process.

What is needed in the art is a simplified method for setting valve displacement in a fuel injector that involves fewer parts to be assembled, that involves parts that can be easily manufactured, and that can be easily integrated into a high volume manufacturing operation. It is a principal object of the present invention to provide a variable shim and valve seat assembly that enables a simplified method for setting the injector valve stroke.

SUMMARY OF THE INVENTION

Briefly described, a variable shim and valve seat assembly in accordance with the invention includes single ramped surfaces, such as a single face thread, or multiple ramped surfaces as features on the top surface of an injector valve seat and a mating shim surface. Valve stroke setting is achieved by rotating the seat relative to the injector body, thus moving the seat inward or outward depending on the direction of rotation. Once the desired valve stroke is set, the seat is welded to the injector body to achieve a leak free interface. The amount of seat displacement is dependent on the designed ramp angle, the number of ramps, and the degree of rotation. Stroke setting tolerances that can be achieved with the variable shim may be improved over known prior art methods since the seat can be axially loaded to create a significant force between the shim and seat face surface features during stroke setting and welding. Stroke setting tolerance may be in a +/−3 to 5 micron range.

In an alternative embodiment of the invention, the shim geometry may be included in the injector body eliminating the shim as a separate part.

The variable shim and seat assembly may be assembled in any injector that depends on an accurate displacement of a valve mechanism to control the delivery of fuel. The method for setting the valve displacement in a fuel injector in accordance with the invention is simple, utilizes parts that can be easily manufactured at relatively low costs, and provides for accurate setting of the injector stroke.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates referred embodiments of the invention, in one form, and such exemplification is not to be construed as limiting the scope of the invention in any manner.

DESCRIPTION OF THE PREFERRED EMBODIMENTS

Figure 1:
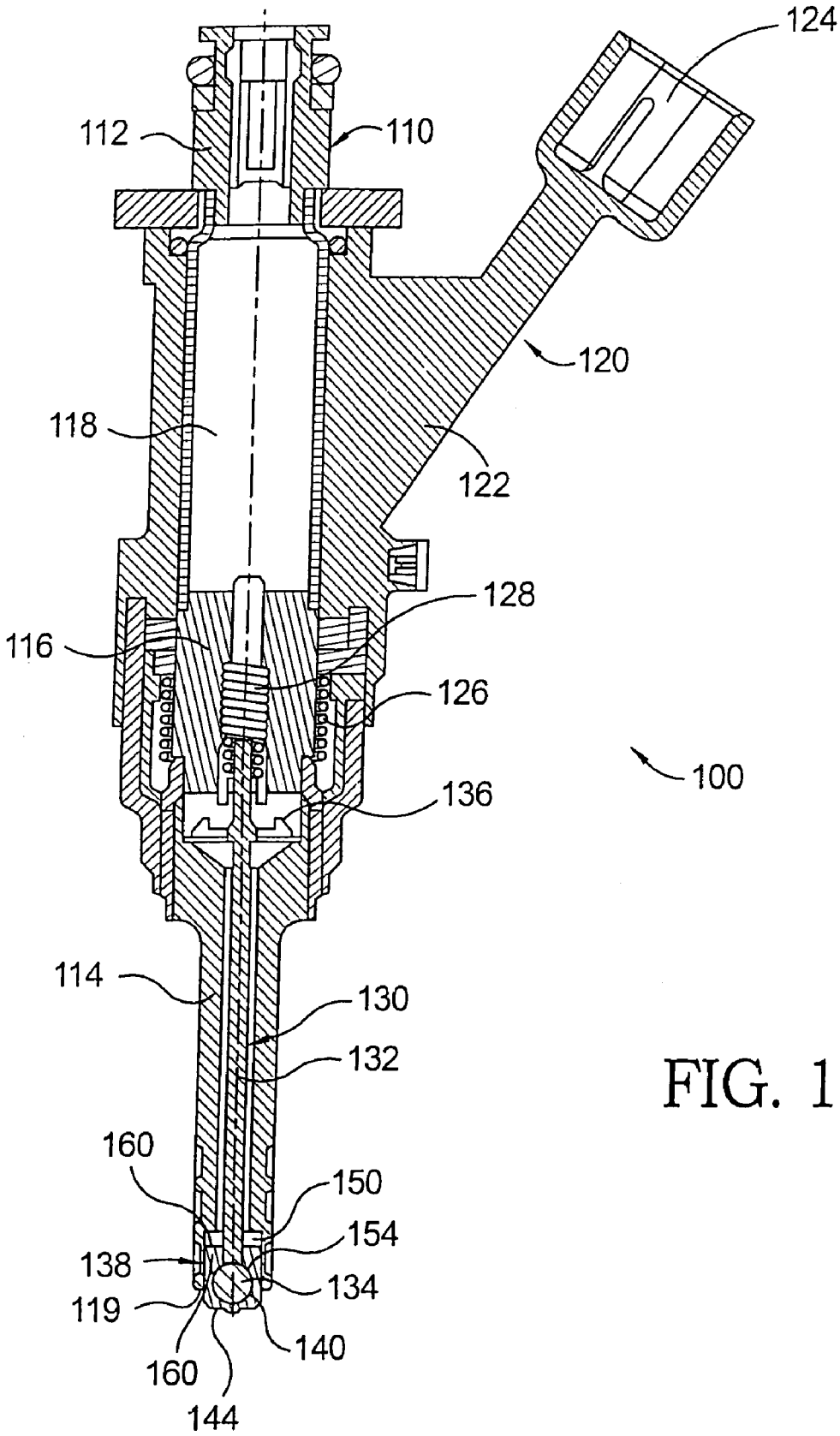
FIG. 1 is a cross-sectional view of a solenoid actuated fuel injector, in accordance with the invention.

Referring to FIG. 1, a solenoid actuated fuel injector 100 includes a cartridge assembly 110 and a solenoid assembly 120. Fuel injector 100 may be, for example, an injector for direct injection.

Cartridge assembly 110 includes all moving parts and fuel containing components of injector 100, such as an upper housing 112, a lower housing 114, a pole piece 116 positioned between upper housing 112 and lower housing 114, and a valve assembly 130. In one aspect of the invention, lower housing 114 may include a circumferential groove 138 or may be otherwise thinned out at the outer circumference for application of a continuous hermetic laser penetration weld. Upper housing 112, lower housing 114, and pole piece 116 enclose a fuel passage 118.

Solenoid assembly 120 includes all external components of injector 100, such as an actuator housing 122, an electrical connector 124, and a coil assembly 126. Solenoid assembly 120 surrounds pole piece 116.

Valve assembly 130 includes a pintle 132 having a ball 134 attached at one end and having an armature 136 attached proximate to an opposite end. Valve assembly 130 further includes a valve seat 140 assembled within lower housing 114 at a lower end 119. Valve seat 140 may extend beyond lower end 119 of lower housing 114. An inner diameter of lower housing 114 is designed to receive an outer diameter of valve seat 140 such that valve seat 140 is axially and radially movable within lower housing 114. Valve seat 140 extends axially from a top surface 142 to a bottom surface 144. Bottom surface 144 of valve seat 140 includes a plurality of spray holes that may be opened or closed by ball 134. Valve seat 140 may be formed, for example, by metal injection molding. Armature 136 is positioned proximate to pole piece 116. Ball 134 is positioned within valve seat 140. Valve assembly 130 constitutes the moving mass of fuel injector 100. Valve assembly 130 is positioned within lower housing 114 such that reciprocating movement of valve assembly 130 is enabled.

Solenoid actuated fuel injector 100 is a linear devices that meters fuel per electric pulse at a rate proportional to the width of the electric pulse. When injector 100 is de-energized, reciprocating valve assembly 130 is released from a first stop position where armature 136 contacts pole piece 116 and accelerated, for example by a spring 128, towards the opposite second stop position, located at bottom surface 144 of valve seat 140. The displacement of valve assembly 130 between the first and the second stop position constitutes the stroke of valve assembly 130.

A variable shim 150 is preferably positioned adjacent to top surface 142 of valve seat 140. Variable shim 150 may be installed within lower housing 114 in a fixed position, for example with a light press fit, such that shim 150 may not rotate within lower housing 114. Shim 150 and valve seat 140 include mating features 160 at an interface 154, such as mating single ramped surfaces 156/146 (shown in FIGS. 2*a* and 2*b*, respectively) or mating multiple ramped surfaces 158/148 (shown in FIGS. 3*a* and 3*b*, respectively) that enable easy and accurate setting of the stroke of valve assembly 130 by rotation of valve seat 140 relative to variable shim 150 and, consequently, relative to lower housing 114. Shim 150 may be formed from a material that has a relatively high hardness and is highly fuel resistant, for example stainless steel. Shim 150 may be, for example, a machined part, a cold formed stamped part, or a metal injection molded part.

In an alternative embodiment, mating feature 160, such as single ramped surface 156 (FIG. 2*a*) or multiple ramped surface 158 (FIG. 3*a*) included in shim 210 or 310, respectively, may be integrated in the lower housing 114 of fuel injector 100. Mating feature 160 may be formed at an inner circumferential contour of lower housing 114. Accordingly, shim 150 could be eliminated as separate part. In the alternative embodiment, lower housing 114 may be formed as a deep drawn part to save cost over a machined part.

Figure 2B:
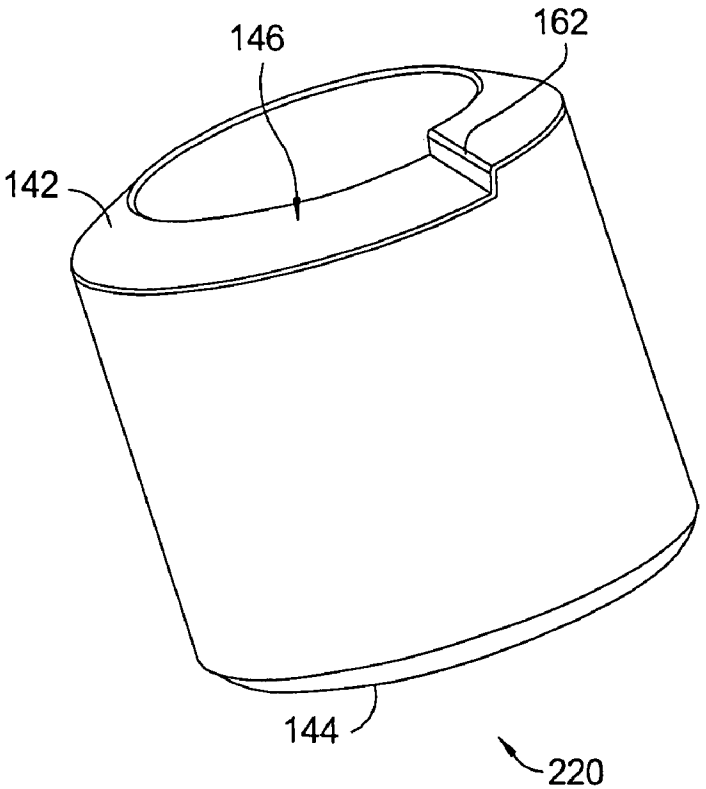
FIG. 2*b* is an isometric view of a valve seat, in accordance with the first embodiment of the invention.
Figure 2A:
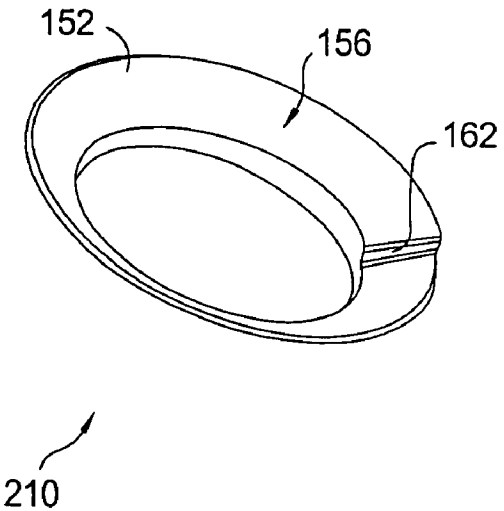
FIG. 2*a* is an isometric view of a variable shim, in accordance with a first embodiment of the invention.

Referring to FIGS. 2*a* and 2*b*, a variable shim 210 and a mating valve seat 220 are illustrated, respectively, in accordance with a first embodiment of the invention. Variable shim 210 includes a face 152 that is designed as a single ramped surface 156. Valve seat 220 includes a top surface 142 that is designed as a single ramped surface 146. Single ramped surfaces 156 and 146 of shim 210 and seat 220, respectively, are mating surfaces. Single ramped surfaces 146 and 156 may be designed as a single face thread. Single ramped surfaces 146 and 156 may include a single helical rise/fall in 360 degrees forming a single ramp 162. The angle of ramp 162 may be selected in accordance with a specific application. Variable shim 210 and valve seat 220 may be assembled in fuel injector 100 as shim 150 and seat 140.

Figure 3B:
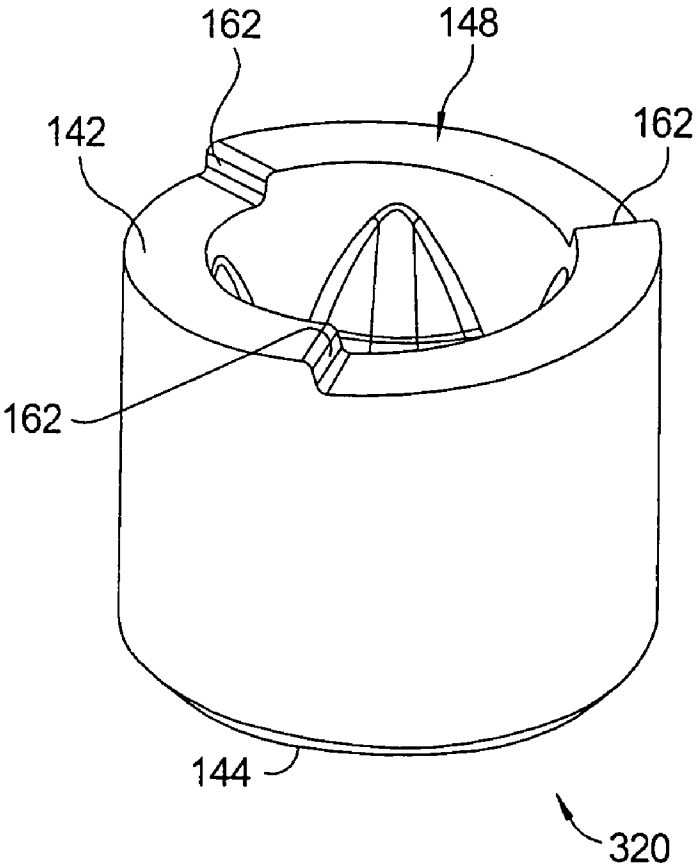
FIG. 3*b* is an isometric view of a valve seat, in accordance with the second embodiment of the invention.
Figure 3A:
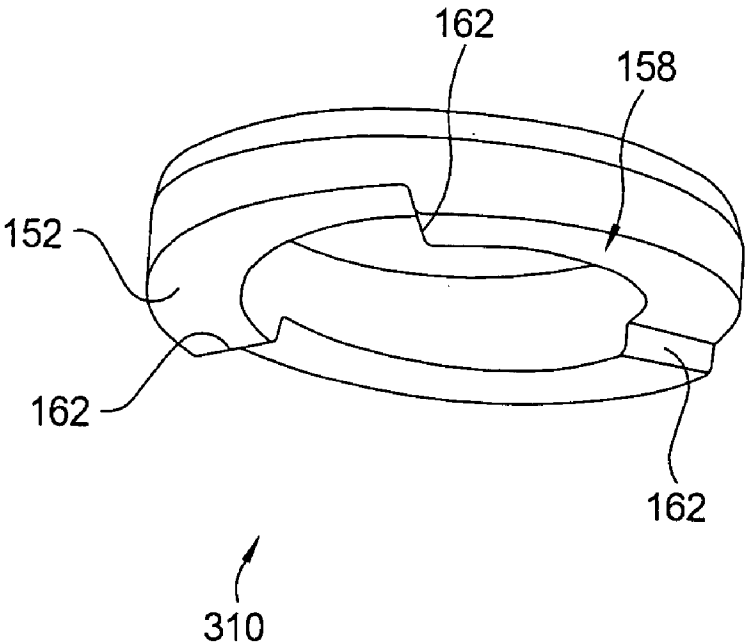
FIG. 3*a* is an isometric view of a variable shim, in accordance with a second embodiment of the invention.

Referring to FIGS. 3*a* and 3*b*, a variable shim 310 and a mating valve seat 320 are illustrated, respectively, in accordance with a second embodiment of the invention. Variable shim 310 includes a face 152 that is designed as a multiple ramped surface 158. Valve seat 320 includes a top surface that is designed as a multiple ramped surface 148. Multiple ramped surfaces 158 and 148 of shim 310 and seat 320, respectively, are mating surfaces. Multiple ramped surfaces 158 and 148 may be designed to include a plurality of helical rises/falls in degrees forming multiple ramps 162. While shim 310 and seat 320 are shown each to include three ramps 162, any other number of ramps 162 may be realized if desired for a specific application. The angle of ramps 162 may be selected in accordance with a specific application. Variable shim 310 and valve seat 320 may be assembled in fuel injector 100 as shim 150 and seat 140.

Figure 4:
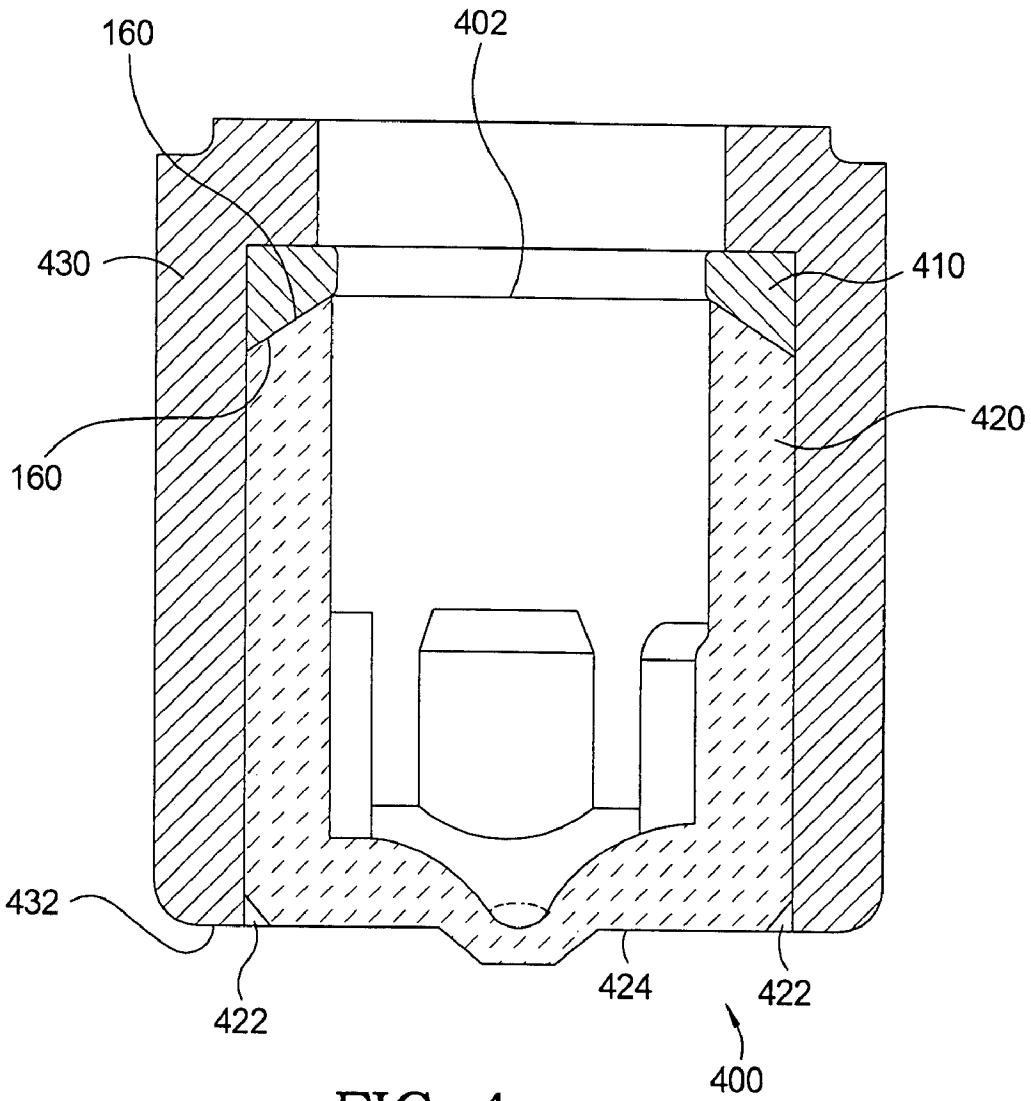
FIG. 4 is a cross-sectional view of a shim and seat assembly in accordance with a third embodiment of the invention.

Referring to FIG. 4, a shim and seat assembly 400 in accordance with a third embodiment of the invention includes a variable shim 410 and a valve seat 420 assembled in lower housing 430 of a fuel injector (such as fuel injector 100 shown in FIG. 1). Mating features 160 formed in seat 420 and shim 410 at an interface 402 may be either single ramped surfaces 146/156 as shown in FIGS. 2*a* and 2*b* or multiple ramped surfaces 148/158 as shown in FIGS. 3*a* and 3*b*. Valve seat 420 may include recesses 422 that facilitate rotation of seat 420 relative to lower housing 430. Contrary to FIG. 1, where lower housing 114 is shortened and valve seat 140 extends beyond lower end 119, bottom surface 424 of valve seat 420 is flush with a lower end 432 of lower housing 430 except in the areas of recesses 422. In further contrast to FIG. 1, lower housing 430 does not include a thinned out area at the outer circumferential contour for application of a continuous hermetic laser penetration weld. Still, a 360-degree laser penetration weld may be applied on close proximity to interface 402 of shim 410 and seat 420 by radially welding through lower housing 430 into seat 420.

Referring to FIGS. 1 through 4, stroke setting of valve assembly 130 is achieved by rotating valve seat 140 or 420 relative to variable shim 150 or 410, respectively. Due to the mating features 160 included in shim 150 or 410 and valve seat 140 or 420, such as mating single ramped surfaces 156/146 (shown in FIGS. 2*a* and 2*b*, respectively) or mating multiple ramped surfaces 158/148 (shown in FIGS. 3*a* and 3*b*, respectively), valve seat 140 or 420 may be moved inward or outward of lower housing 114 or 430 depending on the direction of rotation. Accordingly, mating features 160 provide axial displacement of valve seat 140 or 420 through rotation of valve seat 140 or 420 relative to variable shim 150 or 410, respectively. The amount of seat displacement is dependent on the ramp angle, the number of ramps, and the degree of rotation of valve seat 140 or 420 relative to lower housing 114 or 430, respectively.

Once the desired valve stroke is set, valve seat 140 or 420 is fixed to lower housing 114 or 430, respectively, for example by welding, and preferably by laser penetration welding. Preferably a continuous weld is formed for 360 degrees between valve seat 140 or 420 and lower housing 114 or 430. Laser penetration welding has the advantage that a hermetic seal is created between valve seat 140 or 420 and lower housing 114 or 430 concurrently, eliminating the need for separate sealing features. As shown in FIG. 1, the lower housing may be thinned out, for example by forming groove 138, at the location of the weld. The weld is preferably located in close proximity to the seat/shim interface 154 or 402 and as far away as possible from the position of ball 134. During stroke setting and welding processes, an axial load may be applied to valve seat 140 or 420 creating a significant force at the interface 154 or 402 of shim 150 or 410 and valve seat 140 or 420. Application of this load enables stroke setting within tight tolerances and prevents changes to the stroke due to the heat development during the welding process. As a result, tolerances in a range of about 3-5 microns may be achieved.

The displacement or stroke setting of valve assembly 130 in fuel injector 100 is done prior to the calibration of fuel injector 100, preferably in the cartridge assembly state of the manufacture. Valve seat 140 needs to be in a fixed position relative to lower housing 114 before the spray holes included in bottom surface 144 of valve seat 140 are oriented relative to solenoid assembly 120.

While variable shims 150, 210, 310, and 410 and valve seats 140, 220, 320, and 420 have been shown and described for assembly in direct injection fuel injector 100, they may be useful in any type of injector that depends on an accurate displacement of a valve mechanism, such as valve assembly 130, to control the delivery of any type of fuel.

By integrating mating features into the interfacing surfaces of the shim and the valve seat (such as shims 150, 210, 310, and 410 and valve seats 140, 220, 320, and 42), accurate setting of the injector valve stroke is enabled with simple parts that can be manufactured relative easily and at relatively low costs and with a simple stroke setting method.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for setting valve displacement in a fuel injector, comprising the steps of:

forming a face of a variable shim as a first mating feature including at least one ramp;

fixing said variable shim into a lower housing of said fuel injector;

forming a top surface of a valve seat as a second mating feature including at least one ramp;

assembling said valve seat to be axially and radially movable within said lower housing such that said second mating feature interfaces with said first mating feature;

applying an axial load to said valve seat;

rotating said valve seat relative to said variable shim and said lower housing to move said valve seat inward or outward of said lower housing;

setting said valve displacement; and fixing said valve seat to said lower housing.

2. The method of claim 1, further including the steps of:

reducing an outer diameter of said lower housing; and forming a continuous hermetic laser penetration weld for 360 degrees between said valve seat and said lower housing at said reduced diameter.

3. The method of claim 1, further including the step of:

removing said load after said valve seat is fixed to said lower housing.

* * * * *